United States Patent [19]

Wells

[11] Patent Number: 4,998,590

[45] Date of Patent: Mar. 12, 1991

[54] HORIZONTAL AUGER FOR SKIDSTEER TRACTORS AND THE LIKE

[75] Inventor: Allen Wells, 5956 Maleville Ave., Carmichael, Calif. 95608

[73] Assignees: Allen Wells; David Hansen, both of Sacramento, Calif. ; a part interest

[21] Appl. No.: 352,416

[22] Filed: May 15, 1989

[51] Int. Cl.[5] ..... E21B 7/02

[52] U.S. Cl. ..... 175/162; 175/87; 175/203; 173/22; 173/24; 173/28; 173/29

[58] Field of Search ..... 175/62, 162, 170, 202, 175/203, 87; 173/22, 24, 28, 29

[56] References Cited

U.S. PATENT DOCUMENTS

| | | | |
|---|---|---|---|
| 2,752,122 | 6/1956 | Hyatt et al. | 175/62 |
| 2,969,844 | 1/1961 | Hamrick | 175/62 |
| 3,431,983 | 3/1969 | Jacobson | 173/22 |
| 3,917,005 | 11/1975 | Cannon et al. | 173/28 |
| 3,957,124 | 5/1976 | Desourdy | 173/28 |
| 4,099,579 | 7/1978 | Stormon | 173/28 |
| 4,199,033 | 4/1980 | Van Gundy, Jr. | 173/29 |
| 4,417,628 | 11/1983 | Gessner | 173/22 |
| 4,641,716 | 2/1987 | Sjalander | 175/162 |
| 4,813,499 | 3/1989 | McNulty | 175/162 |

*Primary Examiner*—Bruce M. Kisliuk

*Attorney, Agent, or Firm*—Mark C. Jacobs

[57] ABSTRACT

An apparatus is provided that is mountable upon preferably a skidsteer tractor, through a forklift truck or similar wheeled vehicle could be employed. The apparatus can be lowered into a trench on one side of a street or sidewalk and used to bore axially beneath the street or sidewalk to a trench on the other side of the street or sidewalk. Operation of the apparatus, which uses conventional commercial augers is controlled from the hydraulic couplings situated in the skidsteer tractor.

The apparatus includes a main housing which includes a means for receiving the accessory shoe of a prime mover for physical attachment thereto; and a motor housing with a motor, hydraulic coupler and bearing disposed therein, which motor housing is pivotally mounted to the main body.

10 Claims, 3 Drawing Sheets

HORIZONTAL AUGER FOR SKIDSTEER TRACTORS AND THE LIKE

FIELD OF INVENTION

This invention pertains to a horizontal augers which are intended to be mounted on skidsteer tractors and other vehicles for boring beneath, streets, sidewalks, conduits and other impediments that make direct vertical trenching not feasible, when cables, piping and the like are to be laid beneath the impediment.

BACKGROUND OF THE INVENTION

Ofttimes it is necessary to lay pipe or wires beneath a driveway, sidewalk or the like. Typically such is necessary when sprinkler systems, outdoor lighting, or other utility improvements such as security systems or street lights or traffic lights are to be installed at locations where the sidewalks and/or the streets are already in place. Direct trenching would require that a street's traffic flow be interrupted during the pipe or cable laying. Or, in the case of a home, the homeowner does not want the expense of having to re-lay his concrete driveway after the pipes or wiring in question are laid in place.

Today, for these types of situations, a trench is dug on both sides of the impediment, such as a driveway, and then a connection is made between the two trenches. This can be carried out by hand digging beneath the impediment, using picks and shovels; or by directing a stream of high pressure water at the dirt or rock beneath the impediment. Both of these procedures are time consuming and do involve a certain amount of difficulty. In the case of the water, there is always the problem of drainage for or pump removal of the accumulated water not to mention the possibility the erosion of the surrounding substrate adjacent the bore which could result in a cave in of the street or sidewalk which is being bored under.

There is a need therefore, for a safe, sure, easy to achieve, low cost method of boring or tunnelling beneath impediments of the nature recited above. Such an apparatus is provided by the invention of this application.

It is an object therefore to provide an auger that can be readily attached to a skidsteer tractor (SST) for horizontal boring and which operatively controlled by the hydraulic system of the SST.

It is another object to provide an auger that can be quickly attached and detached to the mounting foot of an SST.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the appended claims.

For a fuller understanding of the nature and objects of the invention, reference should be had to the following detailed description, taken in connection with the accompanying drawings.

SUMMARY OF THE INVENTION

An apparatus adapted for horizontal boring mountable to the mount shoe of a skidsteer tractor, which apparatus can be lowered into a trench to drill beneath a sidewalk, street, culvert or the like. The apparatus includes a main body and a motor housing, which holds the motor, hydraulic coupler and bearing, pivotally mounted thereto. The center of gravity of the auger used therewith acts to retain the drive shaft of the apparatus in a generally horizontal position.

DESCRIPTION OF THE PREFERRED EMBODIMENT

Figure 1:
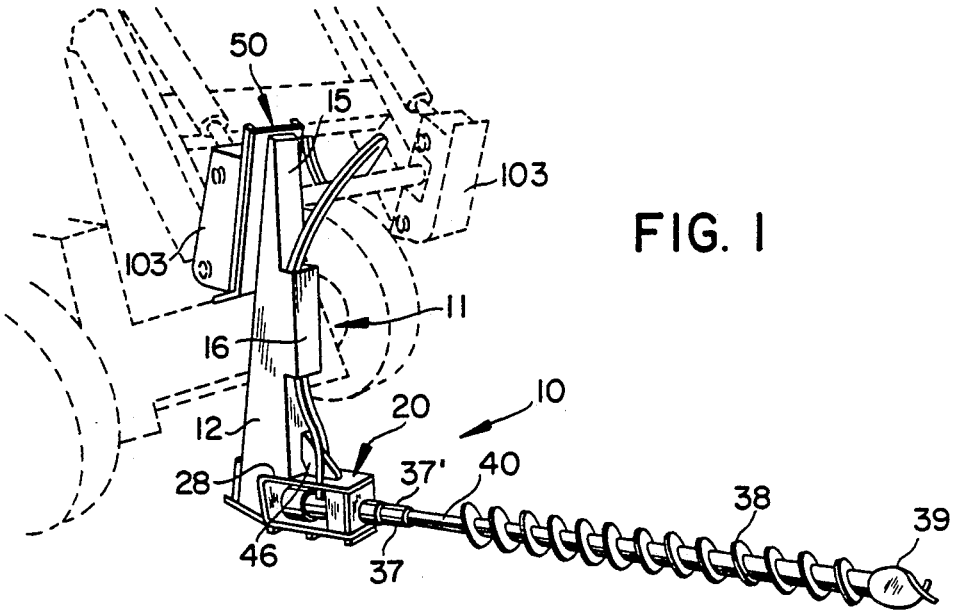
FIG. 1 is a front perspective view of the auger of this invention, shown mounted on a Bobcat™ skidsteer tractor.

In FIG. 1, the auger device 10 of this invention is shown mounted on a tractor of the skidsteer variety. As is known, a skidsteer tractor has no turnable wheels. Turns are negotiated by locking up the left or right front and rear wheels such that the unlocked side's front and rear wheels can continue to move forward, the result being the ability to make a full right turn on a minimum turning radius. While the apparatus of this invention will be shown in the drawings and discussed as being intended primarily for usage on such skidsteer tractors, for instance those sold under the Bobcat trademark among others, the use of the inventive apparatus for standard steerable tractors is of course contemplated, as is the mounting of this apparatus on other prime movers, such as compactors.

Apparatus 10 includes a main housing 11, having a pair of spaced sidewalls, 12, 14, each of which is generally triangular shape. The rear surface of each of these side walls may be generally vertical with the front edge depending outwardly from the top edge. A front wall 15 is disposed preferably flush with the front edge of the two side walls 12, 14, per FIGS. 1 and 5.

A trapezoidally shaped cutout 28, (see FIG. 6) which deletes an entire section of the bottom of the front wall 15 and part of the bottom area of the two side walls, extends rearwardly from the front edge of the two side walls to the two trapezoidal segments, i.e. 17 on the near side and 18 on the far side of the side walls, for the purpose of nestingly receiving the motor housing 20. The description of the motor housing 20 which has mounted thereon at least one, and preferably two upstanding flanges with a pin receiving bore therein for disposition within the opening in the underside of the main housing will be recited infra.

Figure 5:
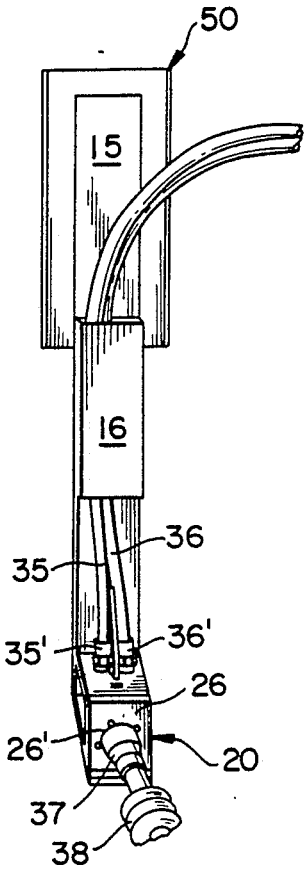
FIG. 5 is a front perspective view of the apparatus of this invention.

Main housing 11 also includes an elongated U-shaped retainer 16 which is mounted at about the midpoint of the front wall 15 to retain the hydraulic lines used to operate the apparatus and which are shown in FIG. 5.

Figure 3:
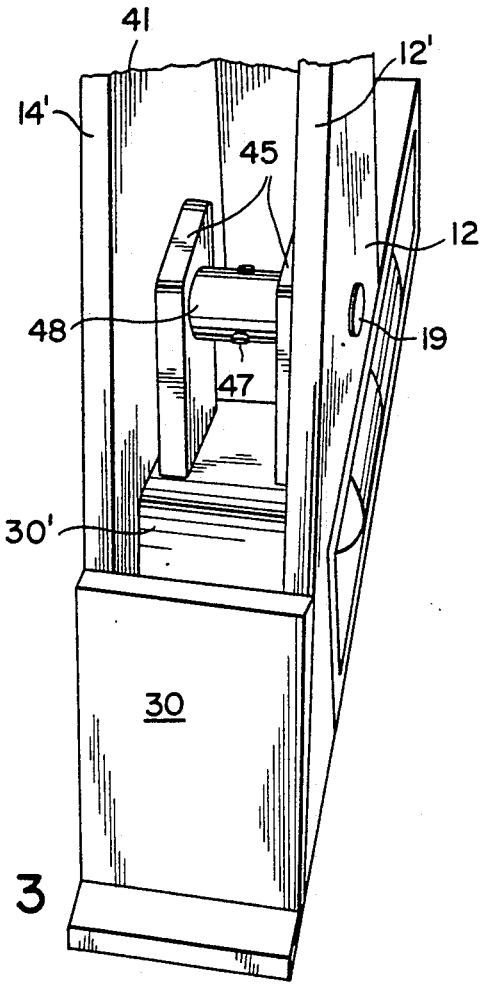
FIG. 3 is a rear perspective view of the mounting portion of the apparatus of this invention.
Figure 4A:
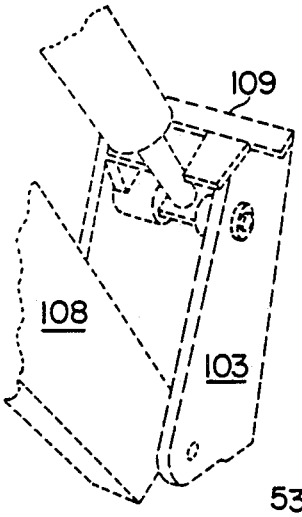
FIG. 4 is a rear perspective view showing the apparatus of this invention.
Figure 4B:
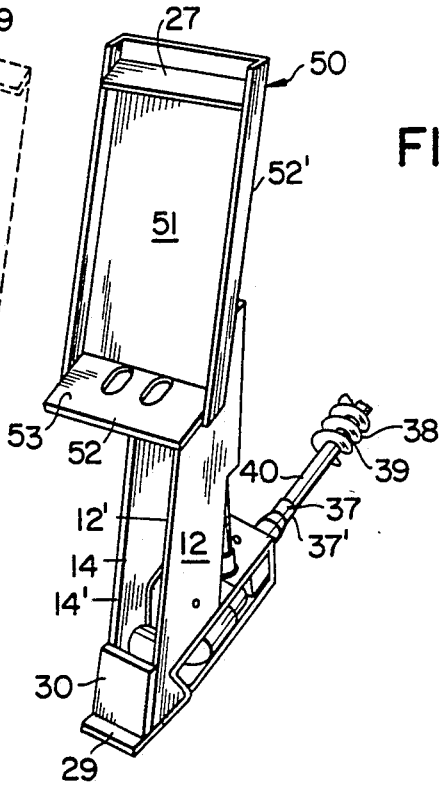

In FIG. 4 there is seen the adapter plate 50 for the engagement of the particular tractor to this apparatus 10. The adapter plate 50 is welded to and becomes an integral part of the apparatus. Reference is made to the discussion of FIG. 3 for the adapter plate for a J.I. Case skidsteer tractor. Whereas in the variant of the apparatus discussed with respect to FIG. 2, the adapter plate for a Bobcat is depicted.

Returning now to FIG. 4, the adapter 50 which as indicated is integrally attached to and forms a part of apparatus 10 includes a generally rectangular main portion 51, to which is attached top plate section 27 which constitutes the top wall of this device and is seen to be disposed spaced down from the upper edge of the generally rectangular main portion 51 of the adapter 50 and from the top edge of two spaced sidewalls 52' of said adapter 50. At the bottom of main portion 51 is a rearwardly integral lip 52 having a pair of spaced slots 53 therein. Main portion 51 is seen to have an obverse side—FIG. 4—that faces the accessory shoe of the tractor and a reverse side—FIG. 5—which is welded or otherwise attached to the two side walls 12, 14 of this device. Preferably main portion 51 extends beyond sidewalls 12, 14. See FIG. 5.

Rear edges 12', 14' of side walls 12, 14 respectively of apparatus 10 extend from the bottom wall or plate 29 of apparatus 10 up toward the midpoint of the elevation of the apparatus. A small reinforcing plate 30, also extends upwardly from the bottom plate 29 superposed upon a portion of rear edges 12' and 14'.

Figure 6:
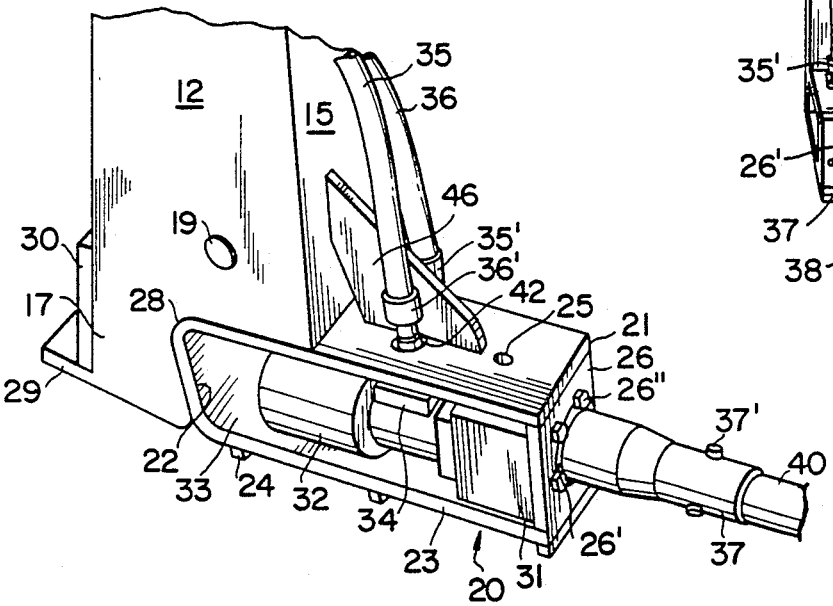
FIG. 6 is a closeup perspective view of another portion of this invention.
Figure 7:
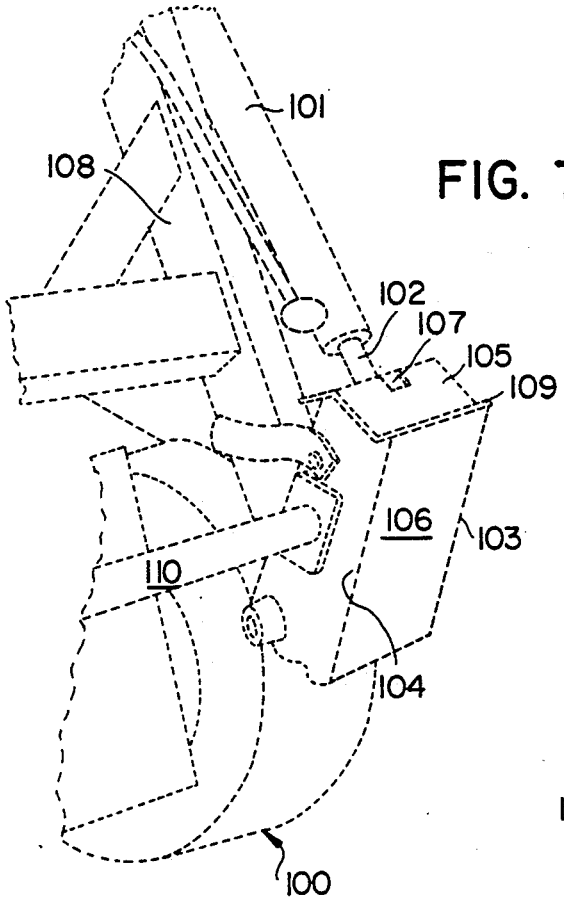
FIG. 7 shows the accessory mounting foot of a skidsteer tractor which is used to engage the apparatus of this invention for operation by such a tractor.

FIG. 7 shows the accessory quick release mounting means of a skidsteer tractor which is used to engage the apparatus of this invention for operation by such a tractor. While this device forms no part of this invention, a brief discussion of same is necessary for understanding the operation of the instant apparatus. Suffice it to say at this point that accessory shoe 103 of the skid steer tractor 100 will be described below in detail and is shown in FIG. 1 engaging the instant apparatus via opening 30'. This opening is located between the top wall 27 and the lower lip 52 of the adapter plate 50, upper edge of the rear edges 12', 14' of side walls 12 and 14. In FIG. 6, the motor housing 20 is seen to be disposed within cutout 28 previously mentioned. This motor housing 20 includes a top wall 21, which has oil bore 42 therein which bores leads to and communicate with bearing 31 for the lubrication thereof. Motor housing 20 also includes a rear wall 22, which is disposed downwardly and forwardly from top wall 21 at the rear thereof. Bottom wall 23 extends from said rear wall 22 forwardly and generally parallel to top wall 21 and spaced therefrom. Front wall 26, includes a central opening 26' per FIG. 5, said opening being for the passage of the drive shaft not seen, is disposed parallel to both of said top and bottom walls 21, 23 and therebetween, while the wall itself is disposed normal to said top and bottom walls, 21, 23. Front wall 26 may be welded or otherwise secured to said top and bottom walls. Preferably the top wall 21, the rear wall 22 and bottom wall 23 are integral as one piece. A reinforcing gusset 46 is welded or otherwise secured to top wall 21 of the motor housing preferably at a location between the connections for hydraulic lines 35, 36. This gusset serves not only to add strength to the unit, but as an antiflexing stop should the motor unit attempt to counter-rotate.

Bearing unit, 31, such as one made by Helland and designated a model 400 OVERHUNG LOAD ADAPTOR or equal is bolted to the front wall 26 by bolts 26'', such as ½'' bolts, and motor 32 is conventionally mounted to the inner surface of bottom wall 23 within the motor area 33. Conventional hydraulic couplers 34 are disposed between said motor 32 and said bearing 31 with suitable inputs, not seen, for receiving the two hydraulic lines 35, 36, which are connected through bores 42 in the top wall 21 to said couplers 34 via standard quick disconnect couplings 35' and 36' per FIG. 6. The other end of lines 35, 36 are connected to the power take off of the tractor. Obviously other conventional mount means are also contemplated.

The reader's attention is also called to the plurality of spaced bar rests or feet 24 disposed on the underside of bottom wall 23 to prevent damage thereto. These rests 24, are best seen in FIG. 6.

A power coupler, 37 seen in FIGS. 1, 4, 5, and 6 is conventionally secured via a key way to said bearing for and is welded to the drive shaft of the bearing. An auger 38 such as those made by Pengo among others such as the one shown in FIGS. 1 and 4 includes a cutter portion 39 and a shaft 40. Shaft 40 is received by power coupler 37 and retainer in place by set screws 37' which enter into threaded bores in said shaft 40, said threaded bores not being visible due to their small size. The coupling of the power coupler 37 to the drive shaft is deemed to be conventional in the art.

Figure 8:
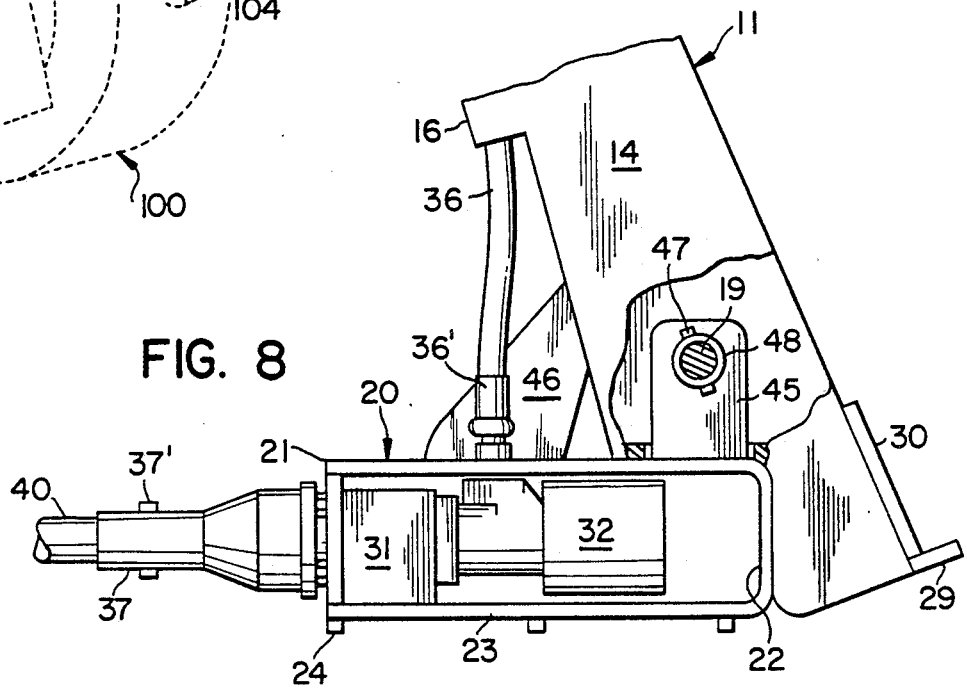
FIG. 8 is a cutaway view showing the pivotal mounting of the motor housing relative to the main body.

Reference should now be made to FIG. 3 and FIG. 8 which depicts the interior of apparatus 10. As is seen, top wall 21 includes a pair of spaced plates 45 mounted thereon, with the spacing such that they fit within the confines of the side walls of the apparatus. Each flange 45 is connected by a normally disposed tubular member 48, disposed within a suitable bore of each flange, but not through the two side walls. Pin 19 discussed below, permits the rotation of the tubular member 48.

FIG. 8 is a diagrammatic elevational view also showing the pivot flanges 45 that are mounted as by welding, to the top wall 21 of the motor housing 20. These members are retained by pivot pin 19 which extends through the two side walls, 12, 14 of the main body housing 11, per FIG. 8 and through the tubular member 48. The tubular member is connected thereto by cotter pin 47 (also seen in FIG. 3) which is disposed in aligned bores within each of pin 19 and tubular member 48.

The discussion turns now to FIGS. 4 and 7 which depict the mode of attachment of the apparatuses of this invention to tractor 100. Tractor 100 includes a pair of hydraulic cylinders 101, only one of which is seen in FIG. 7, from which is extending piston rod 102, which is seen to be connected to the accessory mounting shoe 103. Again only one of the spaced pair of mounting shoes is visible in each of FIGS. 4 and 7. Mounting shoe 103 comprises a pair of spaced side walls, 104; a top wall 105 overlying the two spaced sidewalls 104; a front wall 106, which extends upwardly beyond the upper edge of the two side walls; a piston connector 107 conventionally mounted within the confines of mount shoe 103, and a forwardly tilted lip 109, angled upwardly from the top wall 105 and extending slightly beyond front wall 106. Tractor 100 also includes a connecting arm 110 to couple the two mounting shoes 103 for simultaneous operation as well a pair of pivotally mounted relative to the mounting shoe fixed arms, 108. These are used for positioning the apparatus 10 relative to the work site. Mounting shoes of the nature just described are well known in the art and form no part of this invention.

Suffice to say that top mounting plate 27 of apparatus 10 does not extend all the way forward on its underside to the front wall 15, (FIG. 5), even though it may fit flush with said front wall on its upper surface, such that angled lip 109 can fit behind the top wall to lock in the mount shoe to apparatus 10. The balance of the mount shoe is sized to be received within opening 30', just above rear wall 13 of the apparatus. Further detail need not be recited as this is indeed a conventional mounting mode for accessories for tractors such as tractor 100.

Figure 2:
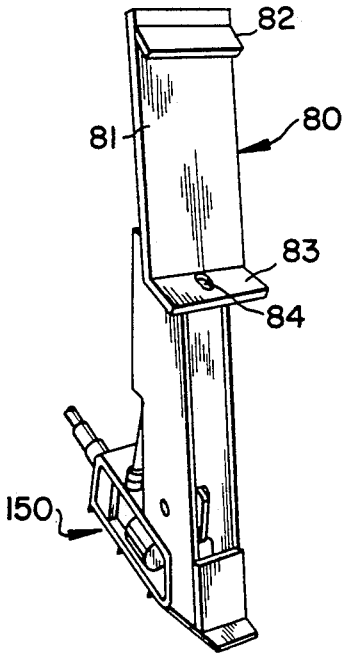
FIG. 2 is a perspective view of a second embodiment of the apparatus of this invention.

In FIG. 2, a variant of the apparatus 10 is seen. Here apparatus 150 is seen to differ in two ways. Firstly, is the exclusion of a gusset plate similar to gusset plate 46 which was added as noted previously to reinforce the interface between the main body and the motor housing and to serve as a forward stop to prevent excess tipping forward of the main body relative to the motor housing.

The second difference seen here is that the adapter plate 50 is replaced by adapter plate 80. The present adapter plate includes a generally rectangular main portion 81, the spaced down angled rearwardly and downwardly top wall 82, welded thereto, and rearwardly directed integral bottom lip 83 extending from said rectangular portion 81. Lip 83 includes a single slot 84 in the middle thereof. Adapter 80 is sized to fit and mate with the mounting shoe of a Bobcat skidsteer tractor. It should also be understood that the gusset can be included in the embodiment of FIG. 1 as well in that there is no correlation or connection between the model for use with a Bobcat tractor with respect to the inclusion or exclusion of the gusset 151. Hereto, the adapter plate 80 is an integral part of apparatus 150.

OPERATION

After apparatus 10 has been physically mounted upon mount shoe 103, the two hydraulic lines 35, 36 are attached via their quick disconnects to the hydraulic couplers 34. An auger 38 is tightened into place in the power coupler, at which time the device is ready for use. The fixed arms 108 are raised to lift apparatus 10 off the ground for ease of travel. The tractor 100 is then positioned where the desired boring operation is to take place. It is also seen that variations of the basic apparatus can be configured for utilization with various brands of tractors.

Skilled artisans can easily bore horizontally with the apparatus of this invention, using the apparatus designed for mounting on their particular type of tractor.

Since further changes may be made in the above apparatus without departing from the scope of the invention herein involved, it is intended that all matter contained in the above description and shown in the accompanying drawings shall be interpreted as illustrative and not as limiting.

I claim:

1. An auger device for mounting on a tractor, preferably of the skidsteer type, for drilling generally horizontal holes, which device comprises:

a. an elongated main housing having a pair of spaced sidewalls, having means attached to said sidewalls for receiving the accessory shoe of a tractor for physical attachment thereto, b. a motor housing having a front wall and a top wall, pivotally mounted to said main housing at the bottom end of said, main housing and which motor housing has a motor connected to a pair of hydraulic couplers mounted within said motor housing; said hydraulic couplers being accessible for connection to hydraulic lines leading from said tractor, and means for coupling an auger bit to said motor coupled to said hydraulic couplers and extending generally horizontally, wherein the means for coupling an auger bit to said motor comprises: a bearing mounted to the front wall of said motor housing and connectable thereto from said front wall and a power coupler adapted to receive the shaft of an auger bit, coupled to said bearing, and wherein the main housing includes a pair of spaced side walls and is open in part on the underside thereof, and wherein the pivotal mounting of said motor housing to said main housing comprises:

at least one upstanding flange on said motor housing extending into the main housing through the opening on the underside thereof, said at least one flange having an opening therein for receipt of a pin, and said at least one flange being retained within said main housing by a pin extending through the side walls of said main housing and said bores.

2. The device of claim 1 wherein the main housing has spaced front and back walls and spaced side walls normal thereto, and said housing includes a cutout at the lower end thereof from said front and in said side walls to nestingly receive said motor housing;

and said motor housing includes a pair of bored upstanding spaced flanges adapted for disposition within said main housing and mountable thereto.

3. The device of claim 1 wherein the main housing further includes a hydraulic line retainer.

4. The device of claim 3 wherein the hydraulic line retainer is generally U-shaped and is mounted on the front of the main housing.

5. The device of claim 1 wherein the motor housing includes an upstanding gusset to limit counter-rotation of said motor housing.

6. The device of claim 1 wherein the motor housing includes an upstanding gusset to limit counter-rotation of said motor housing.

7. The device of claim 1 wherein the means attached to said device's sidewalls for receiving the accessory shoe of a tractor for physical attachment thereto, comprises an adapter which has a generally rectangular main portion, and which adapter is integrally attached to and forms a part of said device also includes a top plate section which constitutes the top wall of said device and which is spaced down from both the upper edge of the aforesaid generally rectangular main portion and from the top edge of the two sidewalls of said adapter;

said adapter's main portion also includes a rearward integral bottom lip having at least one slot therein.

8. The device of claim 7 wherein the adapter further includes its own sidewalls and has a pair of slots in its bottom lip.

9. The device of claim 1 wherein the means attached to said device's sidewalls for receiving the accessory shoe of a tractor for physical attachment thereto, comprises an adapter which has a generally rectangular main portion, and which adapter is integrally attached to and forms a part of said device also includes a top plate section which constitutes the top wall of said device and which is spaced down from both the upper edge of the aforesaid generally rectangular main portion and from the top edge of the two sidewalls of said adapter;

said adapter's main portion also includes a rearwardly integral bottom lip having at least one slot therein.

10. The device of claim 9 wherein the main housing further includes a hydraulic line retainer which is generally U-shaped and wherein the motor housing includes an upstanding gusset to limit counter-rotation of said motor housing.

* * * * *